US005140337A

United States Patent [19]

Rappaport

[11] Patent Number: 5,140,337

[45] Date of Patent: Aug. 18, 1992

[54] HIGH APERTURE EFFICIENCY, WIDE ANGLE SCANNING REFLECTOR ANTENNA

[75] Inventor: Carey M. Rappaport, Boston, Mass.

[73] Assignee: Northeastern University, Boston, Mass.

[21] Appl. No.: 700,083

[22] Filed: May 3, 1991

Related U.S. Application Data

[63] Continuation of Ser. No. 370,701, Jun. 23, 1989, abandoned.

[51] Int. Cl.[5] ..... H01Q 19/12

[52] U.S. Cl. ..... 343/840; 343/753; 343/755

[58] Field of Search ..... 343/840, 753, 781 R, 343/781 P, 756, 837, 912, 754, 755

[56] References Cited

U.S. PATENT DOCUMENTS 3,096,519 7/1963 Martin ..... 343/756
3,573,833 4/1971 Ajioka ..... 343/753
4,145,695 3/1979 Gans ..... 343/781 CA
4,259,674 3/1981 Dragone et al. ..... 343/753
4,786,910 11/1988 Dragone ..... 343/753

*Primary Examiner*—Michael C. Wimer
*Assistant Examiner*—Hoanganh Le
*Attorney, Agent, or Firm*—Weingarten, Schurgin, Gagnebin & Hayes

[57] ABSTRACT

A microwave single reflector antenna is provided with a large field of view and high aperture efficiency. The antenna exhibits good lateral scanning while preserving excellent focusing capabilities. The high aperture efficiency yields higher antenna performance than a conventional reflector antenna of the same size, or the same performance as a conventional scanning antena of larger size. The antenna has an improved surface configuration defined by a fourth-order profile extended into a three-dimensional focusing surface.

12 Claims, 16 Drawing Sheets

Z 1 38.3 2 36.3 3 33.3
4 29.3 5 19.3 6 9.3
CONTOUR LINE

Z 1 38.3 2 36.3 3 33.3
4 29.3 5 19.3 6 9.3
CONTOUR LINE

HIGH APERTURE EFFICIENCY, WIDE ANGLE SCANNING REFLECTOR ANTENNA

This application is a continuation of application Ser. No. 07/370,701, filed Jun. 23, 1989 now abandoned.

FIELD OF THE INVENTION

This invention relates to reflector antennas, and particularly to high frequency antennas with high aperture efficiency and wide scanning angle.

BACKGROUND OF THE INVENTION

Microwave reflector antennas have long been used as the primary means for transmitting high frequency communication signals to distant receivers. Most reflectors are parabolic, with a single focal point. Incoming plane waves that fall within the aperture of the antenna reflect off the conducting metal surfaces and are directed to this focal point. Consistent with the principle of reciprocity, waves originating from a feed (transmitter) located at the focal point will reflect off the metal surfaces to form an outgoing plane wave without phase error.

Incoming beams that arrive at a non-zero angle with respect to the bore-sight direction and are subsequently reflected by the antenna surface to a detector (receiver) at a focal point are said to be scanned. (The bore-sight direction is the axis of symmetry of the reflecting surface.) Conversely, when a feed is displaced from the focal point, the outgoing transmitted beam is angularly displaced (scanned) from the bore-sight direction. In this case, the field of an outgoing beam at the reflector aperture contains non-planar phase errors. These errors result in a degraded outgoing beam with reduced peak gain, increased sidelobe levels, and filled nulls.

The antenna's effective field of view is defined as the greatest angle at which beams can be scanned without being excessively degraded. Parabolic reflectors are limited to only a few beamwidths of scanning. With a typical focal length to aperture diameter ratio (F/D) of 0.5, these reflectors yield a peak gain scan loss of at least 10 dB at 20 half-power beamwidths corresponding to a field of view of about ±5° for medium quality beams.

Attempts have been made to improve single reflector scanning capability by considering deformed geometries based on the sphere or parabolic torus. Unfortunately, although scanning capability does improve for these more circular geometries, the aperture efficiency (the ratio of usable reflector area to the area of the entire reflector aperture) becomes very low. To maintain acceptable beam quality, typically only a small portion of the much larger reflector area is illuminated by any single beam. Most of the reflector is unused unless close multiple beams are employed.

Dragone, U.S. Pat. No. 4,786,910, discloses an antenna including an ellipsoidal reflecting surface with two focal points and multiple feeds disposed so as to yield scanned beams with a minimum acceptable level of astigmatic aberration. The surface of Dragone is an ellipsoid, i.e., any cross section has the shape of an ellipse. As a consequence, the surface can never be configured to minimize phase error aberrations for all scanned beams within a field of view of ±30°. Also, this design exhibits high astigmatism for unscanned (on-axis) beams.

SUMMARY OF THE INVENTION

A microwave single reflector antenna is provided with a large field of view and high aperture efficiency. The antenna exhibits good lateral scanning while preserving excellent focusing capabilities. The high aperture efficiency yields higher antenna performance than a conventional reflector antenna of the same size, or the same performance as a conventional scanning antenna of larger size. The antenna has an improved surface configuration defined by a fourth-order profile extended into a three-dimensional focusing surface.

The antenna of the invention includes a formed surface adapted to reflect incident microwave radiation towards a centrally disposed detector or detector array disposed within a focal region. Conversely, the surface can reflect microwave radiation emitted by a feed (transmitter) or feed array disposed within a focal region determined by the shape of the surface. The surface can resemble one half of a cylindrical shell, formed by linearly extending a plane curve (referred to as a profile) in a direction perpendicular to the plane of the curve. An antenna based on this surface includes a collection of mutually parallel line feeds disposed along another planar curve known as a focal arc, and in a direction perpendicular to the plane of the arc. Alternatively, the surface can resemble a bowl, formed by including this curve in a three-dimensional surface with two orthogonal planes of curvature. An antenna based on this three-dimensional surface includes a plurality of localized feeds disposed along a planar curve.

BRIEF DESCRIPTION OF THE DRAWINGS

The invention will be more fully understood by reading the following detailed description, in conjunction with the accompanying drawings, in which.

DETAILED DESCRIPTION OF THE INVENTION

Figure 3:
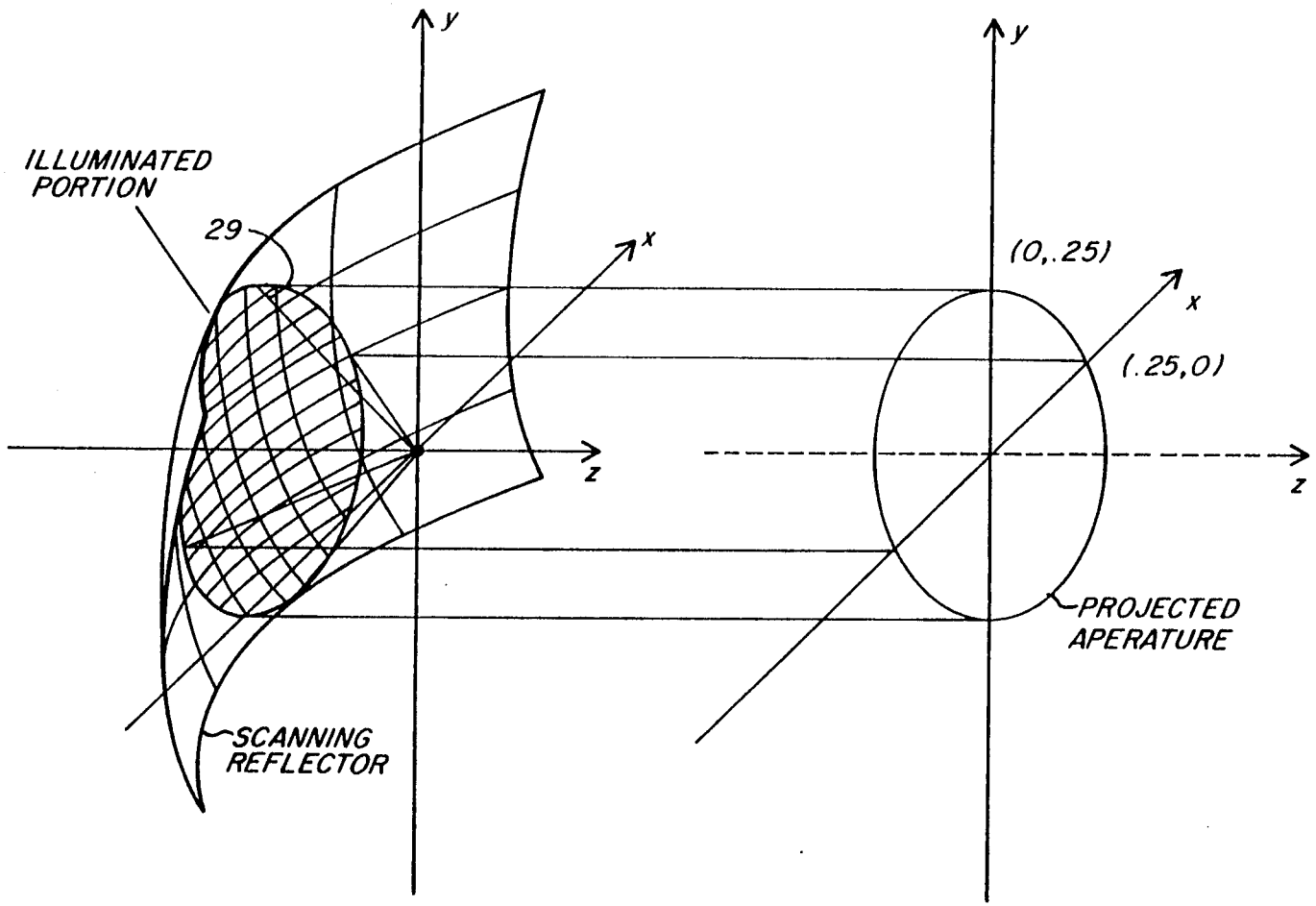
FIG. 3 is an illuminated circular projection on a three-dimensional reflecting surface.

The antenna of the invention includes a formed surface adapted to reflect incident microwave radiation towards a centrally disposed detector or detector array disposed within a focal region. Conversely, the surface can reflect microwave radiation emitted by a feed (transmitter) or feed array disposed within a focal region determined by the shape of the surface. The surface can resemble one half of a cylindrical shell, as shown in FIG. 8A, formed by linearly extending a plane curve (referred to as a profile) in a direction perpendicular to the plane of the curve. An antenna based on this surface includes a collection of mutually parallel line feeds 36 disposed along another planar curve known as a focal arc, and in a direction perpendicular to the plane of the arc. Alternatively, the surface can resemble a bowl, as shown in FIG. 3, formed by including this curve in a three-dimensional surface with two orthogonal planes of curvature. An antenna based on this three-dimensional surface includes a plurality of localized feeds disposed along a planar curve.

Figure 1:
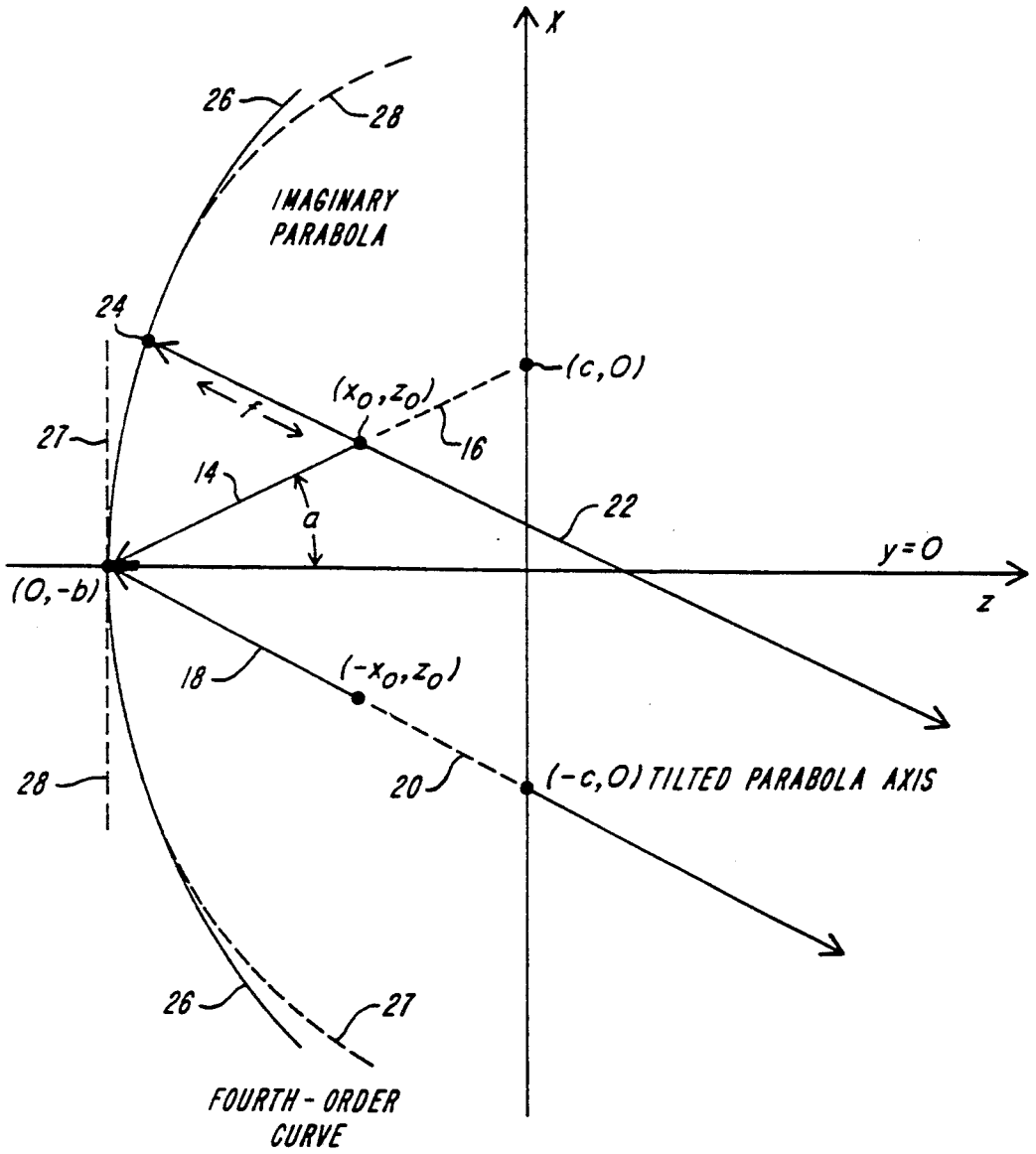
FIG. 1 shows a cross section of a reflecting surface, wherein the cross section is defined by an even fourth-order polynomial, and an associated imaginary parabola.

The geometry of a first embodiment including a plane reflector profile is shown in FIG. 1. The two curves represent a fourth-order plane curve 26 and the an imaginary parabola 28 at the common point $z=-b$, respectively. The parabola 28 has its focal point (focus) at $(x_0,z_0)$. By symmetry, there is a similar lower parabola 27 with a focus at $(-x_0,z_0)$ that meets the parabola 28 at a common central point $(0,-b)$. The slope of the upper parabola 28 at the point $(0,-b)$ is equal to and continuous with the slope of the lower parabola 27 at that point, provided that the ray 14 from the focal point at $(x_0,z_0)$ is colinear with the line 16 connecting the points $(0,-b)$ and (c,O), and the ray 18 from the focal point at $(-x_0,z_0)$ is colinear with the line 20 connecting the points $(0,-b)$ and $(-c,0)$. This profile will approximately focus rays that are parallel to the lines 16 and 20 to points $(x_0,z_0)$ and $(-x_0,z_0)$, respectively. For parallel rays inclined with respect to the z-axis at angles less than the maximum scan angle, a, the profile will approximately focus to other focal points for each scanning angle of interest.

The maximum scan angle, a, of a profile is the angle beyond which incoming rays are not focused properly. Accordingly, $a=\tan^{-1}c/b$ becomes the maximum scan angle of this 2-dimensional profile. The maximum scan angle, a, is uniquely determined by the choice of the magnitude of c. For example, for a given constant value of b, a large value for c will result in a large scan angle. The line 22 connecting the vertex 24 of the upper parabola 28 and its focal point $(x_0,z_0)$ is parallel to the focused rays. The focal point $(x_0,z_0)$ is disposed at a distance f from the vertex 24.

In a coordinate frame rotated by an angle a, an equation of a family of three-dimensional tilted paraboloids can be expressed as follows:

$$z_f(x,y) = b(2t/c^2 - x/c - 1) - \sqrt{(2tb/c)^2(1 - cx/t) - y^2} \quad \text{(Equation 1)}$$

where t is a parameter of the equation of the line represented by $(x_0,z_0)=(ct,b(t-1))$ that passes through the points $(0,-b)$ and (c,0). This line may also be represented as $z=x(b/c)-b$. Each paraboloid has a focal point $(x_0,z_0)$ and includes the point $(x,z)=(0,-b)$. By varying t, one can generate a family of paraboloids, each corresponding to a different focal point $(x_0,z_0)$ for each value of t, and inclined by a scan angle a. To obtain a family of tilted parabolic planar curves that includes the parabola 28 of FIG. 1, set $y=0$ in Equation 1. Such a planar curve represents the profile of the cross section taken at $y=0$ in the x-z plane of a three-dimensional paraboloid. The plane curve profile 26 of FIG. 1 is based on the fourth-order even polynomial:

$$z_{s0}=-b+r_1x^2+r_2x^4. \quad \text{(Equation 2)}$$

The $x^4$ term augments a common unmodified parabolic surface profile in the x-z plane at $y=0$ to provide an excellent fit between $z_{s0}(x)$ 26 and a member 28 of a family of tilted parabolas $z_f(x,0)$. As long as the ratio $r_2/r_1$ is small, the difference between $z_{s0}(x)$ and the corresponding ideal reflector profile is small, near the region where $x=0$. Accordingly, the phase errors resulting from a reflector with the profile $z_{s0}(x)$ are reduced with respect to an unmodified parabola.

The coefficients $r_1$ and $r_2$ are found by using a least squares method, described below, over a specified domain interval that includes only a portion of the reflector profile. The entire profile cannot be optimized simultaneously. To optimally accommodate a scanned beam of a particular angle, only a corresponding profile segment can be used in the least squares method. For example, ideal performance near the z-axis, i.e., at a 0° scan angle, can be sacrificed in return for improved performance at a 30° scan angle. An optimum overall profile is smooth, with a multiplicity of large overlapping segments, each of which can independently reflect rays to its respective focus.

Figure 2:
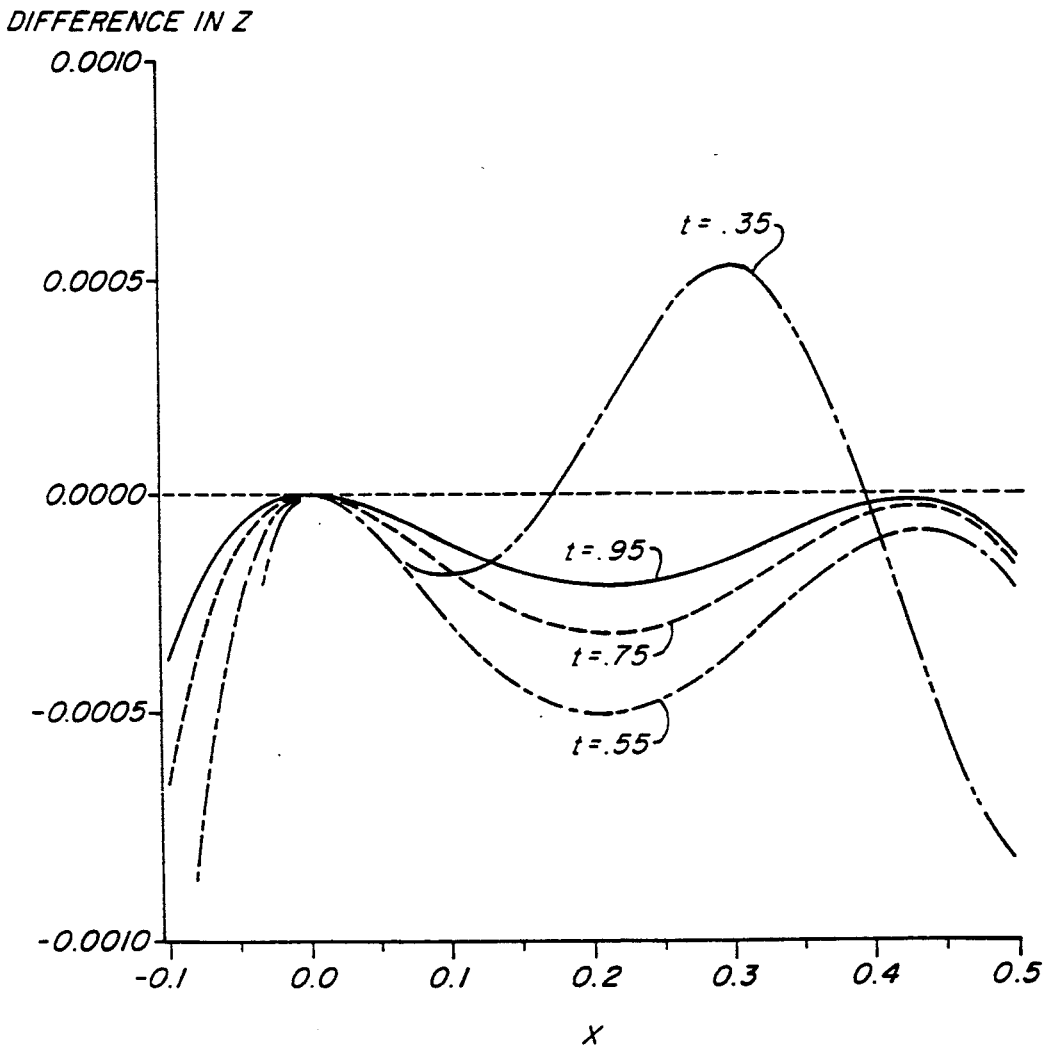
FIG. 2 is a plot of the shape error curves of the imaginary parabola of Equation 1, minus the corresponding profiles of Equation 2 for four values of the focal length parameter t.

It is desirable to have matching segments as large as possible, since each matching segment is the usable portion of the reflector, for each scan angle. In the example case of ±30° scanning, the values $c=0.5$ and $b=0.866$ are chosen, and the segment limits are selected to be $-0.1<x<0.5$. Using a least squares method, the difference (error) between the appropriate tilted parabola (with focal point $(x_0,z_0)$, tilted for 30° scanning, and passing through the reflector vertex $(x,z)=(0,-b)$) and the function of Equation 2 is squared, then differentiated with respect to $r_1$, and in an analogous step, independently differentiated with respect to $r_2$, to determine how the squared error varies with respect to $r_1$ and $r_2$ respectively. Then, the functions that result from the two differentiation steps are sampled at 60 regularly-spaced points, and then summed. The derivative equations are each equated to zero to find the values of $r_1$ and $r_2$ which minimize the total squared error. The error curves corresponding to the difference between the tilted paraboloid profiles of Equation 1, and the fourth error curves of Equation 2 are plotted in FIG. 2 as a function of a focal length parameter t.

For $t=0.95$, the least squares profile curve is $$z=-0.866+0.2398x^2+0.0995x^4$$

The worst-case error for the entire $-30°$ to $+30°$ field of view is $\pm 0.00015$. For a partially illuminated aperture of width 30 wavelengths, the worst-case error is about 0.004 wavelengths, or about 1.5° of phase error. If the domain of X in FIG. 2, i.e., [−0.1, 0.5]is used for a 30 wavelength illuminated aperture, each 0.02 units along the X-axis corresponds to a wavelength. For the full profile of $-0.5 \leqq x \leqq 0.5$ (50 wavelengths), this 30 wavelength illuminated segment represents 60% efficiency across the entire field of view. A conventional torus reflector with a circular profile would have to be 45% larger to achieve similar scanning specifications.

To provide a measure of the full field of view that this profile would have, the 0° (unscanned) case is considered. In this case, the focal point would be at $(x_u, z_u)=(0, -b+f)$ where $f=\frac{1}{4}r_1$ is the focal length of the imaginary unscanned parabola. The error for this boresight beam is greatest at the edges of the intended illumination segment at $x=\pm 0.3$. At these points the deviation from the ideal profile shape is 0.0003 or $\pm 0.008$ wavelengths for the 50 wavelength full profile, as above. A cylinder 38 with a cross section corresponding to this profile, as shown in FIG. 8A, fed by a collection of mutually parallel line sources 36 disposed along the focal arc and perpendicular to the plane of the focal arc, has a field of view that is unsurpassed by any reflector antenna.

In another embodiment, shown in FIG. 3, a three-dimensional profile is provided by adding terms of the form $Py^2+Qx^2Y^2+Ry^4+Sx^4y^2$ to the profile of Equation 2, resulting in the surface described by the equation:

$$z_s=z_{s0}+Py^2+Qx^2y^2+Ry^4+Sx^4y^2 \qquad \text{(Equation 3)}$$

The coefficients P, Q, R and S are found by using a error minimizing procedure to make $z_s$ as close as possible to the ideal tilted paraboloidal surface $z_t(x,y)$ of Equation 1.

Referring to FIG. 3, instead of optimizing over profile segments as in the two-dimensional case, optimization in the case of a three-dimensional scanning reflector 34 is done over circular projections, e.g., the projection 29 corresponding to a circle of radius $r=0.25$ centered at the point $(x,y)=(0,0)$ for the unscanned (0°, boresight or untilted) beam. For the 30° scanned beam, the circular projection is centered at the point $(x,y)=(0.2,0)$.

As before, P, Q, R, and S are each a function of the focal point parameter t. Clearly, as t increases, all focal lengths increase, and the values of these coefficients decrease. However, since the antenna diameter remains constant, a larger value of t would result in a greater focal length to diameter ratio (F/D), which is undesirable.

In order to ensure that this extended surface can focus unscanned as well as scanned beams, the parameter P is first chosen to be equal to $r_1$ of Equation 2. Any difference between P and $r_1$ results in astigmatic aberrations, which strongly degrade the beam shape.

A slight amount of astigmatism is introduced for the unscanned beam by setting $P=r_1+0.02$. Q and S are then adjusted to make the respective positions and directions of the normal vectors for all points along the lateral profile in the $x=0.2$ plane as similar as possible to the corresponding positions and directions of the normal vectors of the tilted parabola lateral profile at $x=0.2$. The value of R is chosen last to minimize errors originating at points on the reflecting surface corresponding to extreme values of y, for both the unscanned and the 30° scanned cases.

The cross sections in both the principal planes (X-Z and Y-Z), centered at $(x,y)=(0.2,0.0)$ of the reflector surface $z_s(x,y)$, matches the corresponding cross sections of the ideal scanning surface, and thus $z_s(x,y)$ minimizes coma, astigmatism, and spherical aberration over this portion of the reflector. For the maximum scan angle, which in the present embodiment is $\pm 30°$, astigmatism is absent, while for the case of 0° scanning, using the same reflecting surface, astigmatism is insignificant. The only aberrations that occur are of higher order, i.e., have a small effect on the beam quality compared to the above mentioned dominant aberrations which are common to a parabolic reflector surface. The slight astigmatism present for the unscanned beam will reduce the antenna's peak gain for 0° scanning and raise the sidelobe levels, but these effects are much less significant than the coma effects normally occurring in paraboloids.

Figure 4:
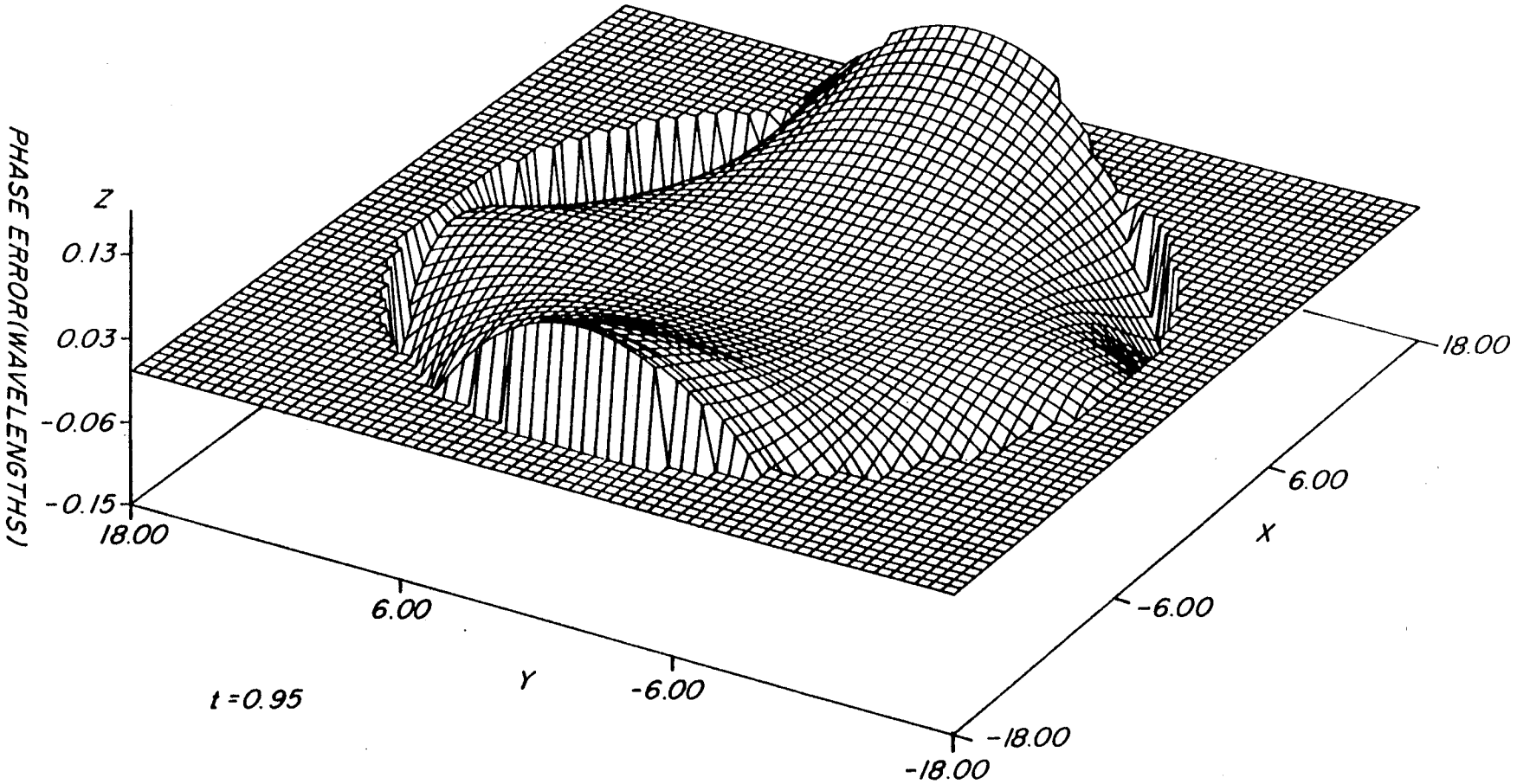
FIG. 4 is a three-dimensional plot of the phase error for a beam scanned at 0°.
Figure 5:
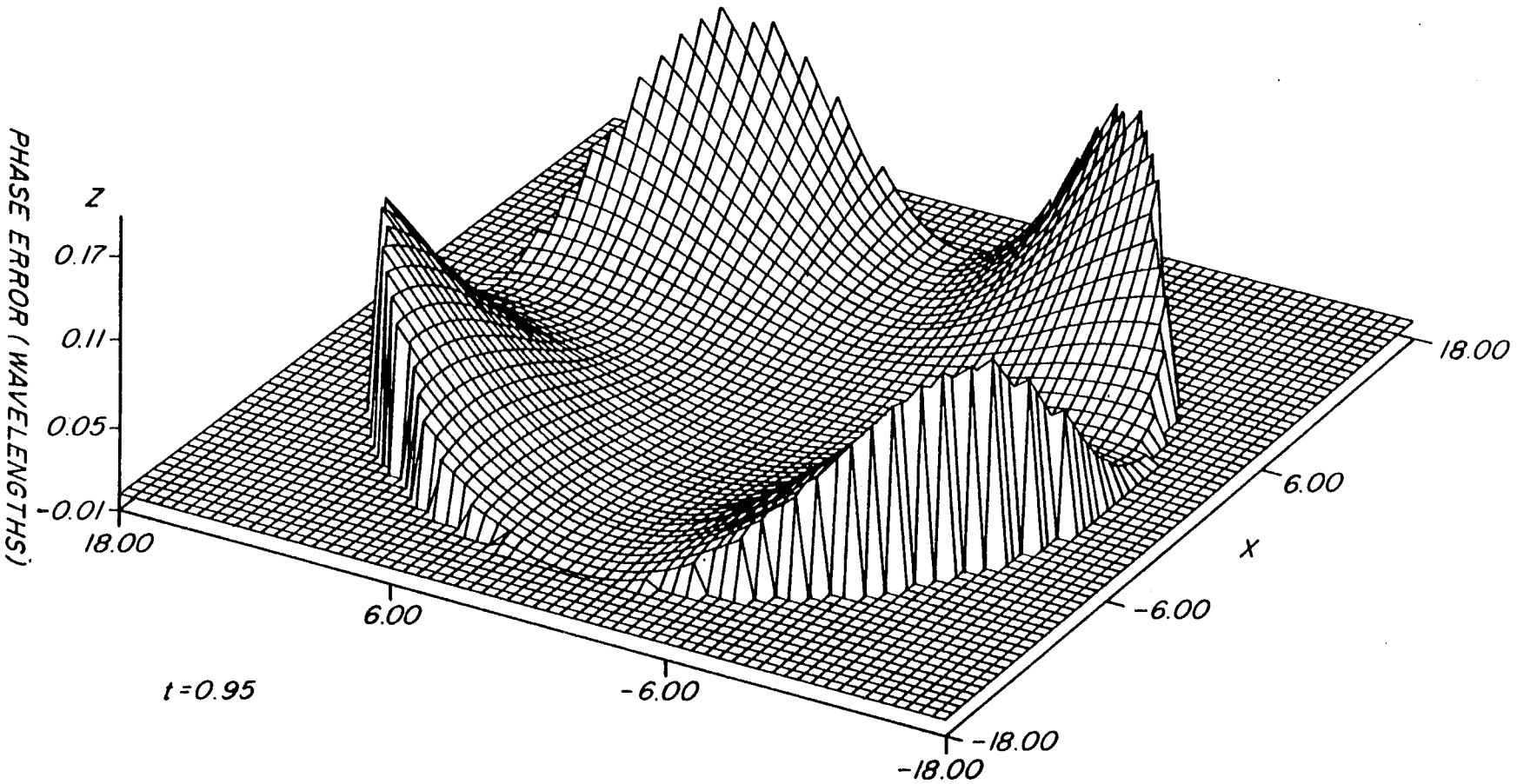
FIG. 5 is a three-dimensional plot of the phase error for a beam scanned at 30°.

Three-dimensional plots of the error at the aperture plane $z=0$ are shown in FIGS. 4 and 5. FIG. 4 is the phase error for the unscanned beam, while FIG. 5 is the phase error for the 30° case, where Z represents the phase error in wavelengths (where one wavelength equals 360°), plotted as a function of position in the aperture plane (X-Y) at $z=0$. These figures represent the surface generated when $t=0.95$, with rays starting at the focal point (0.475,−0.043) for the scanned beam and at focal point (0.0, 0.176) for the unscanned beam, reflected off the best circular (30 wavelength diameter) sections of the surface, and then projected onto the aperture plane ($z=0$). The phase errors across the aperture are all higher order aberrations, and coma is particularly low. Referring to FIG. 4, the unscanned error shows only moderate astigmatism, which is indicated by the extent to which the error surface resembles a saddle shape. Even with the exaggerated scale, the worst errors are less than 0.2 wavelengths, or about a 70° phase error. Much of this error can be compensated for by radially tapering the aperture amplitude distribution to minimize the defocusing effects of the phase errors at the edges of the illuminated aperture.

Figure 6:
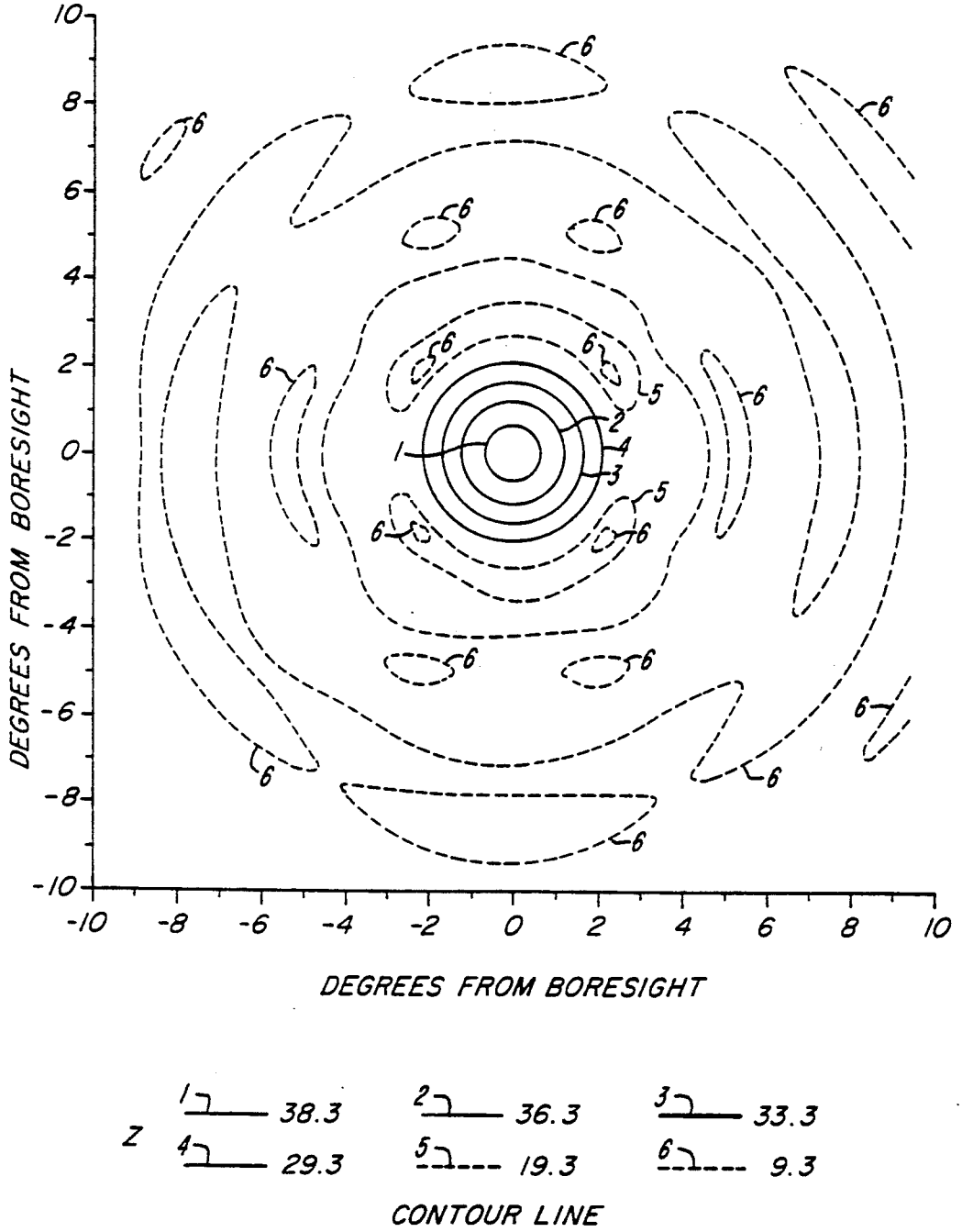
FIG. 6 is a farfield contour pattern of an unscanned beam.
Figure 7:
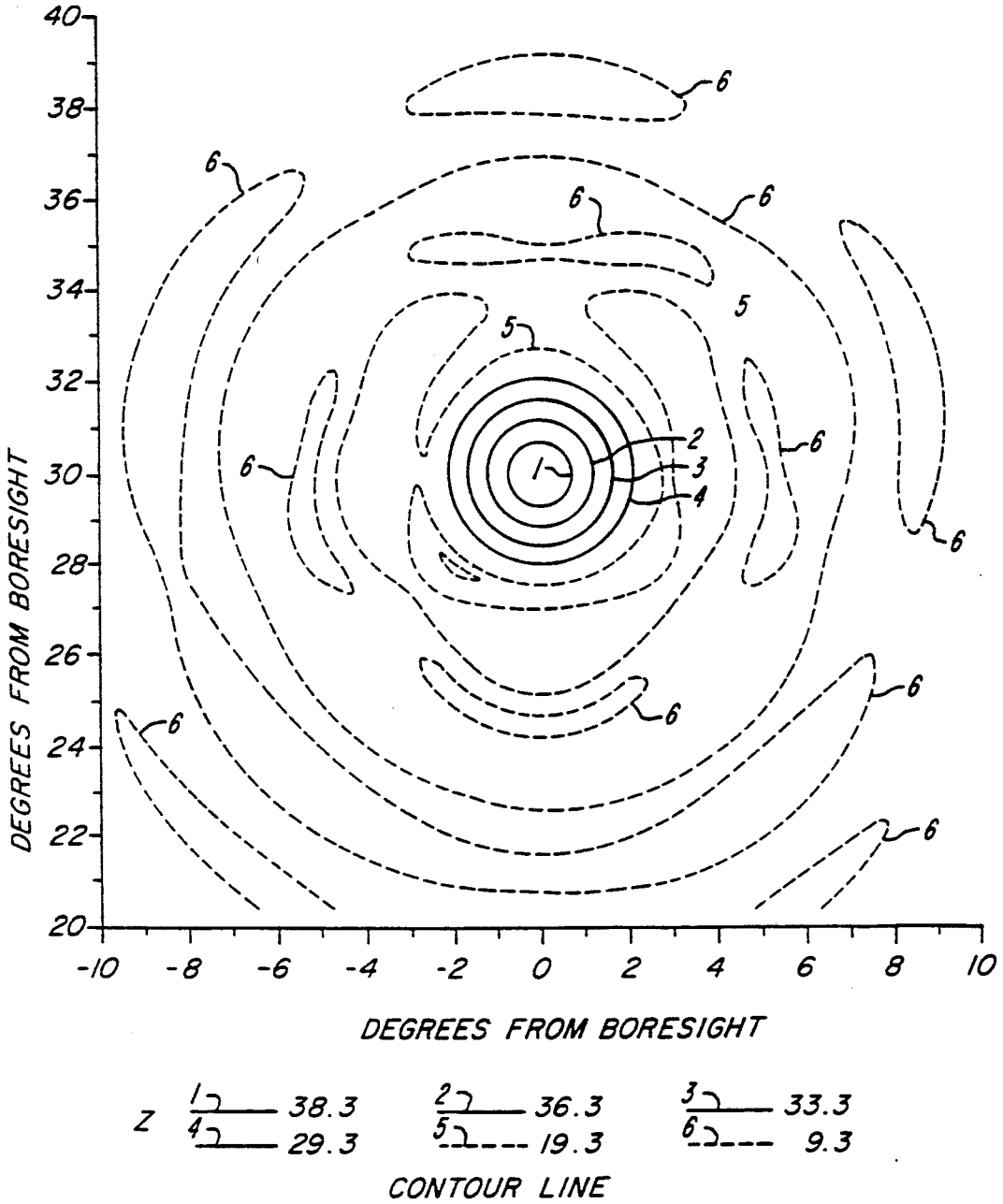
FIG. 7 is a farfield contour pattern of a 30° scanned beam.

Farfield contour patterns of unscanned and 30° scanned beams are shown in FIGS. 6 and 7, respectively. These patterns correspond to the error plots of FIGS. 4 and 5, respectively, where the different values associated with each contour line represent power levels in dB of gain over the power radiated by an isotropic source. The main beams are both circular with high gain and surprisingly low sidelobe levels at −14.5 dB below beam peak.

An advantage of this antenna configuration is its ability to scan the angular extremes while maintaining good performance at its central portion. The surface exhibits good performance at 0°, 30°, and −30°, also showing good performance at angles between −30° and 30°. To find the source points which minimize aperture phase errors, the procedure is as follows: First, a focal line extending from the antenna vertex (axis of symmetry) and inclined from the z-axis at the given scan angle a' is found. Next, rays are traced from trial points along this line, and the errors across an expanded portion of the aperture are computed. A circular region of an aperture of radius 0.25, with the lowest summation of path length deviations from a plane that is perpendicular to a ray in the X-Z plane inclined with an angle a' with respect to the Z-axis is selected.

Figure 8:
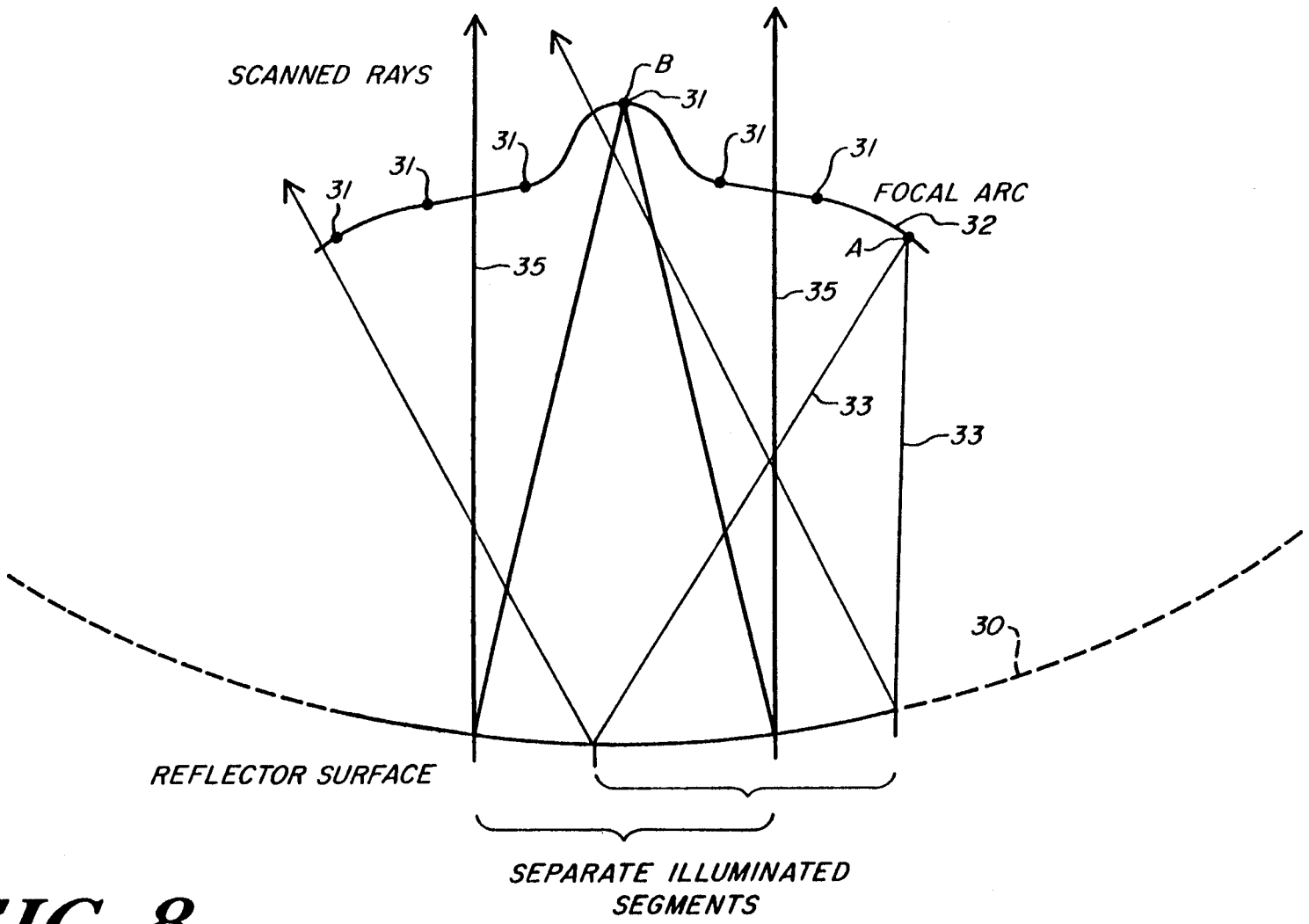
FIG. 8 is a representation of a cross section of a reflector surface in the plane of its focal arc, showing the focal arc, and associated rays.
Figure 8A:
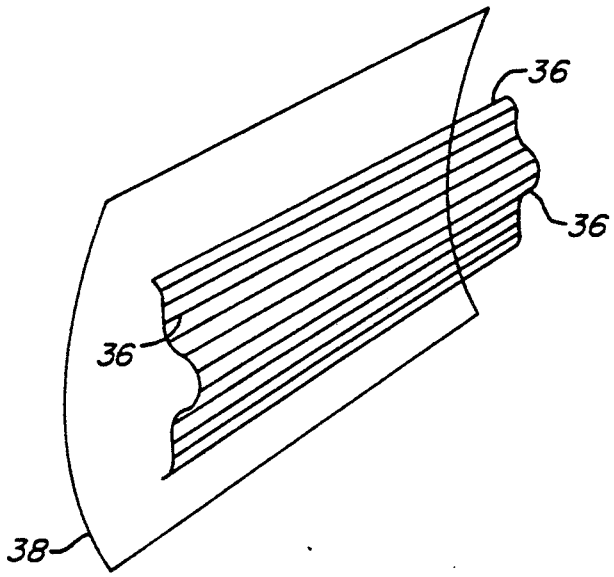
FIG. 8A is an oblique view of an antenna surface that results from linearly extending the cross-section (profile) of FIG. 8 in a direction perpendicular to plane of the focal arc.

The results of this refocusing process for the reflector profile 30 is represented by the focal arc 32 shown in FIG. 8. One or more feeds 31 (transmitter/receivers) may be disposed along the focal arc 32. The rays 33 emanating from the feed A represent a scanned beam, and the rays 35 emanating from the feed B represent an unscanned beam. FIG. 8A provides an oblique view of a reflector antenna structure that results from linearly extending the profile 30 of FIG. 8 in a direction perpendicular to plane of the focal arc 32. Linearly extending each of the feeds 31 results in corresponding linear feeds (line transmitter/receivers) 36 shown in FIG. 8A. Linearly extending the profile (cross-section) 30 results in a so-called "cylindrical" reflecting surface 38 having a cross-section identical to the profile 30 of FIG. 8. Thus FIG. 8 represents a cross-section of the embodiment shown in FIG. 8A.

Figure 9A:
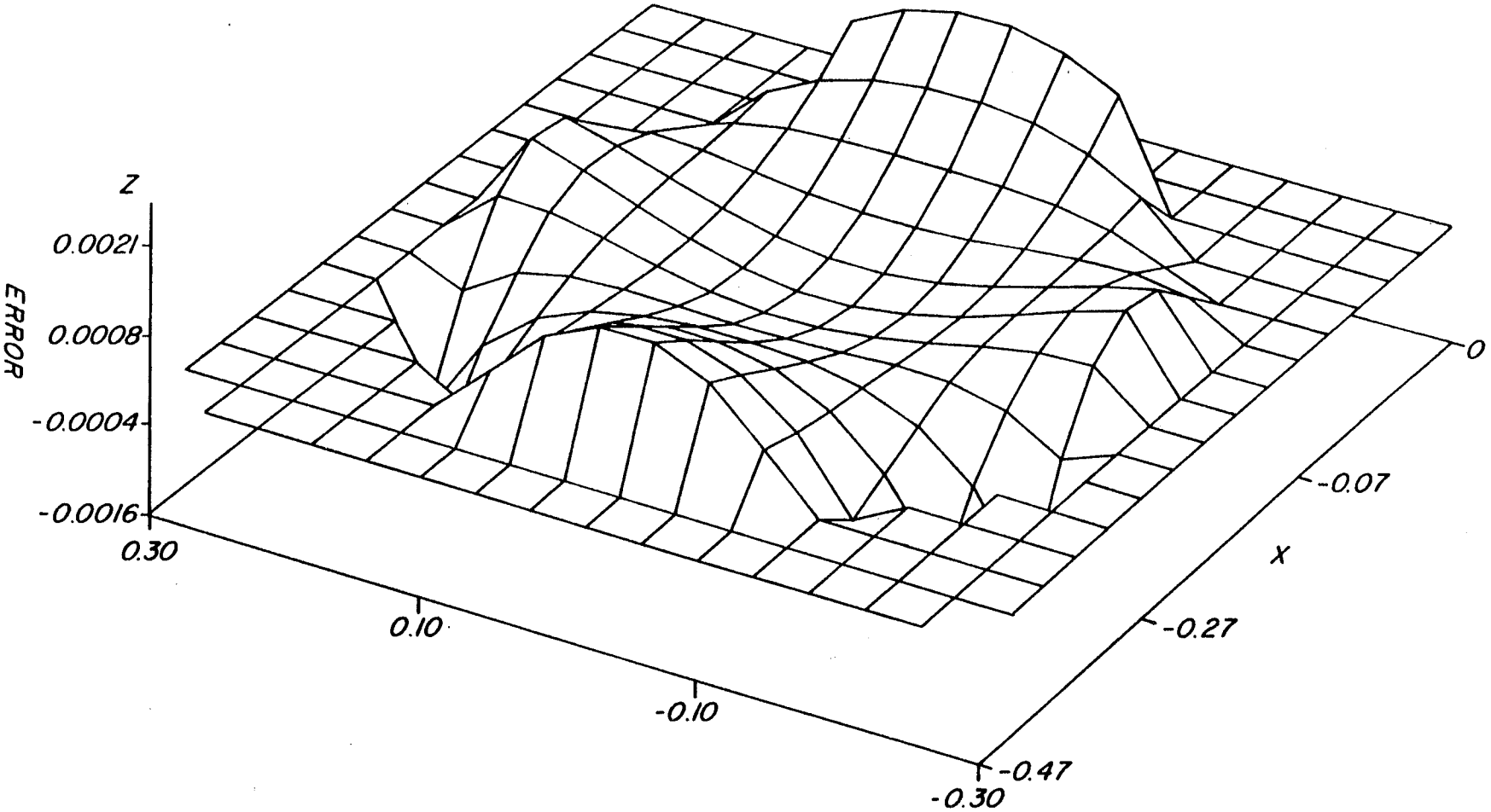
FIG. 9A is a three-dimensional plot of the phase error for a beam scanned at 10°.
Figure 9B:
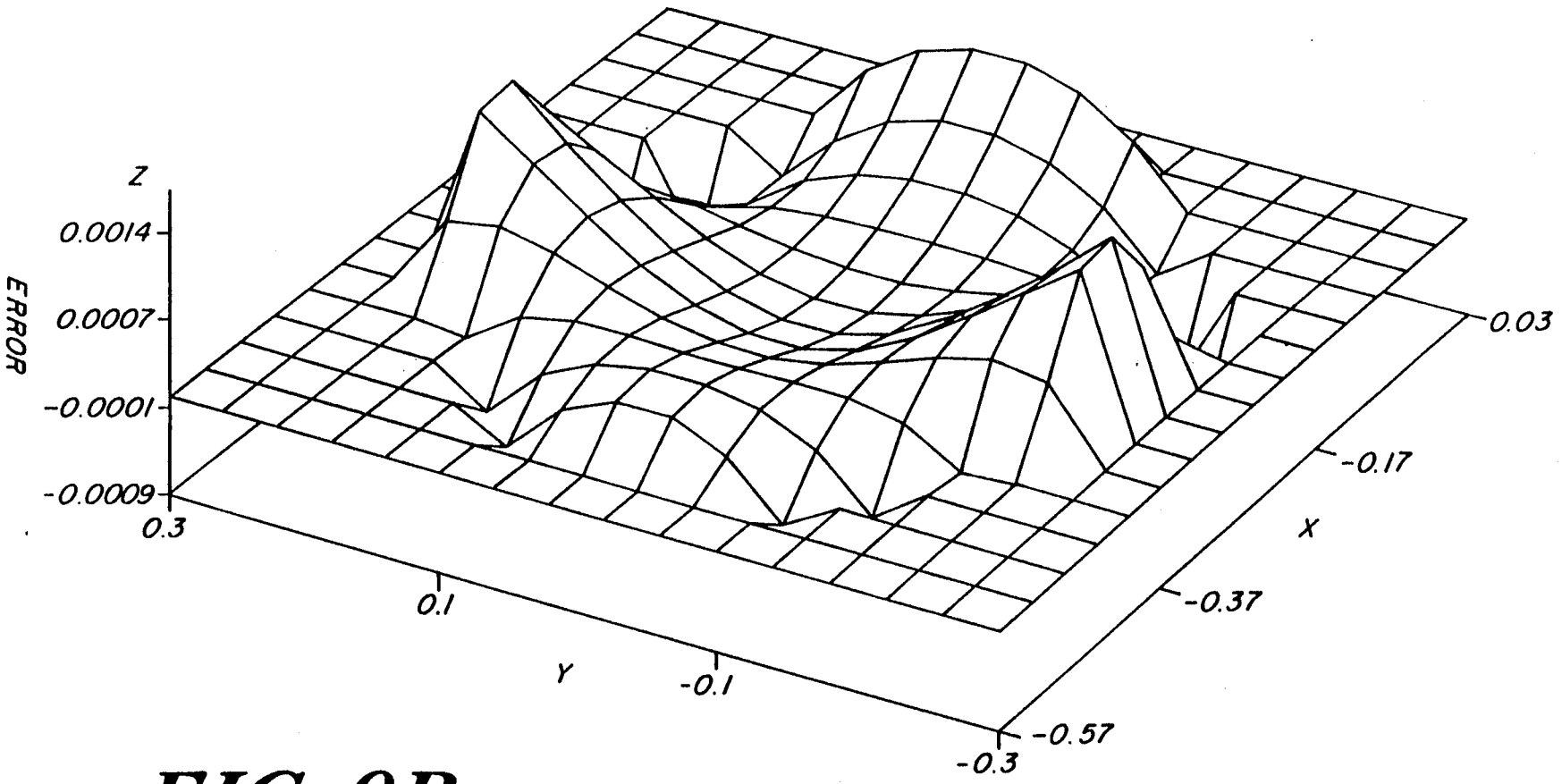
FIG. 9B is a three-dimensional plot of the phase error for a beam scanned at 20°.
Figure 10A:
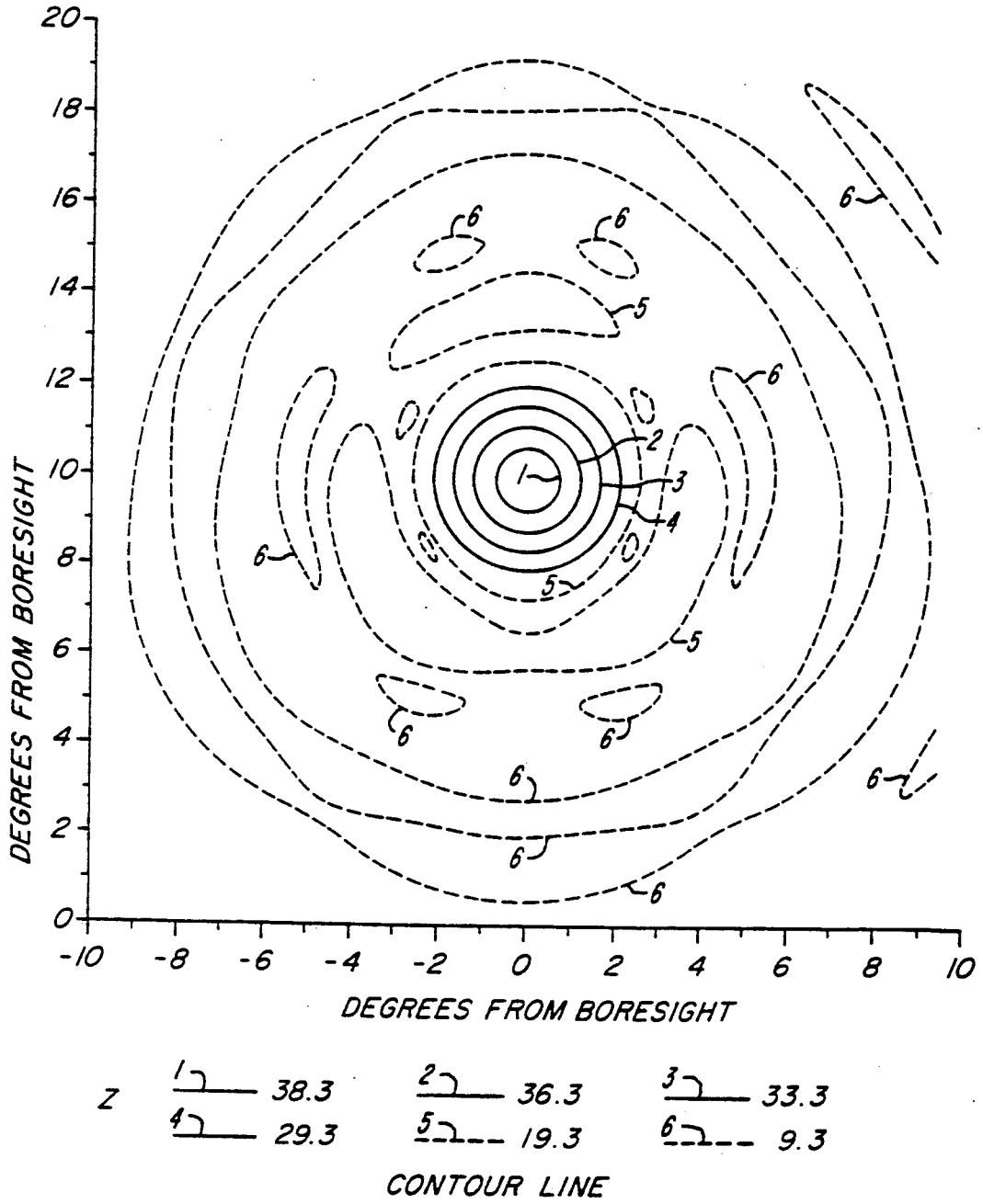
FIG. 10A is a farfield contour pattern of a 10° scanned beam.
Figure 10B:
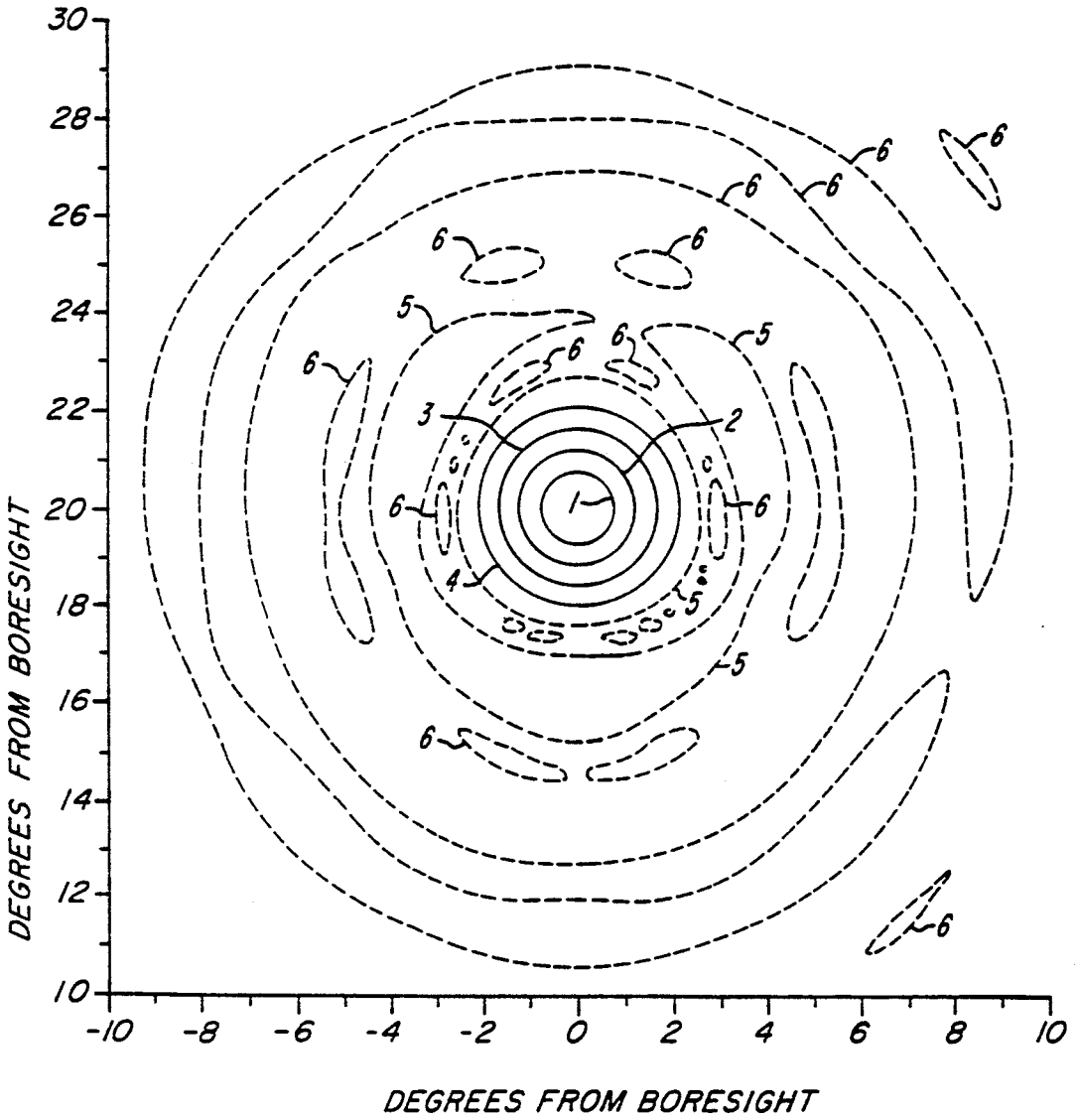
FIG. 10B is a farfield contour pattern of a 20° scanned beam.

The phase errors for 10° and 20° scanned beams are shown in FIGS. 9A and 9B, respectively. The integrated farfield patterns are depicted in FIGS. 10A and 10B, respectively. These patterns indicate the reflector performs well at these intermediate scan angles, with good main beam symmetry, excellent gain, and low sidelobe levels.

Comparing these results with currently-used antennas, a paraboloid with the same width as the surface of the invention, and with focus at the same location as for the unscanned beam was simulated. To maintain similarity between tests, the same type of feed, with a circular uniform illumination function was used.

Figure 11:
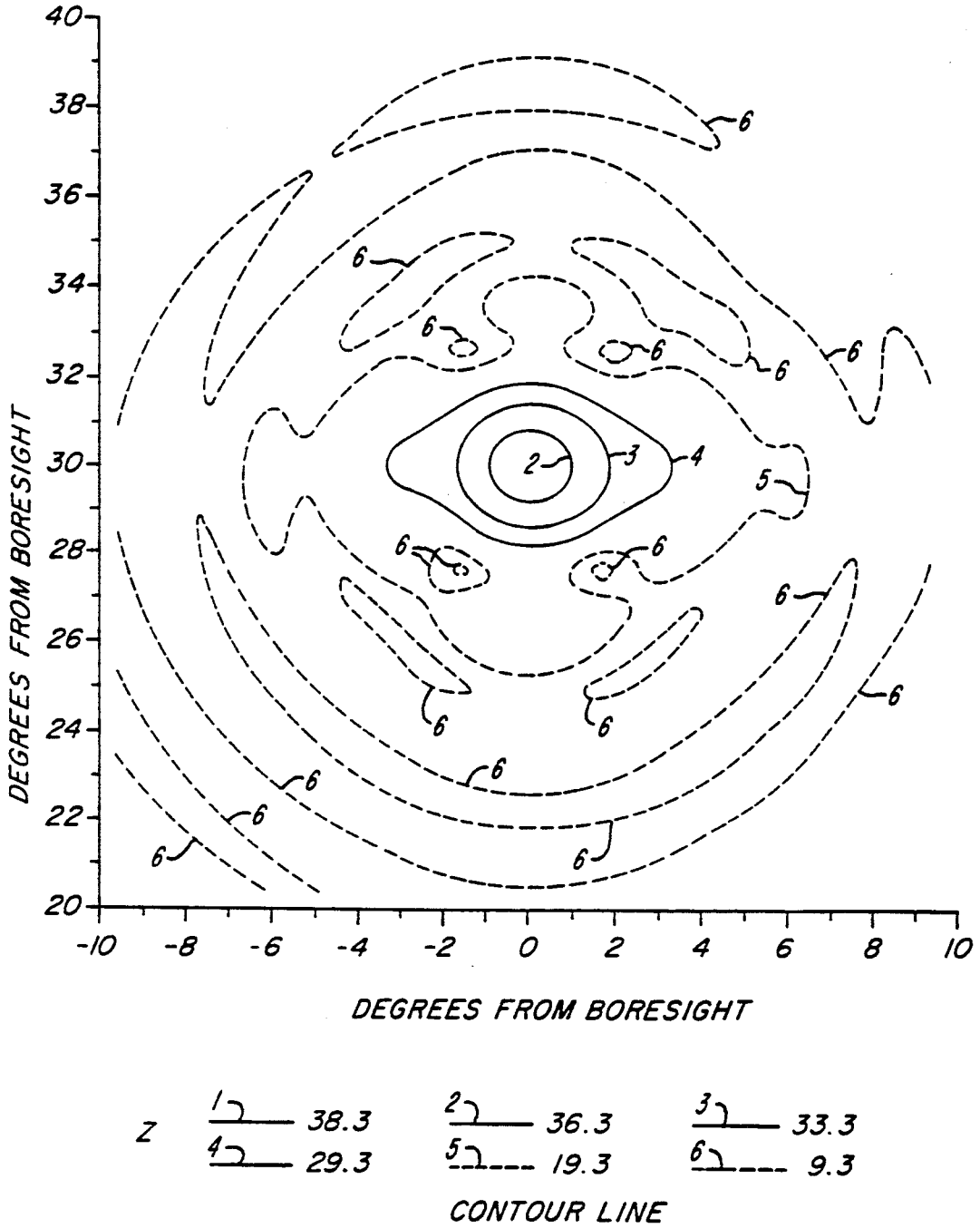
FIG. 11 is a farfield contour pattern of a 30° scanned beam, for a parabola.

For the unscanned beam there is no phase error. The integrated peak gain is 0.2 dB greater, and the first sidelobe level is 2.5 dB lower than for any beam generated by the surface of the invention. The greater peak gain and lower sidelobe level are desireable. However, at 30° of scan, the combination of astigmatism and coma aberrations, shown in FIG. 11, as a stretching of the horizontal portion of the contour and an increase of the first sidelobe level just below the beam center, lead to almost 2 dB loss in peak gain, and 9 dB increase in first sidelobe level. The radiation pattern is asymmetrical, with filled nulls and poorly-formed sidelobes. This error surface for the parabola is found using the same refocusing procedure as previously described.

Figure 12:
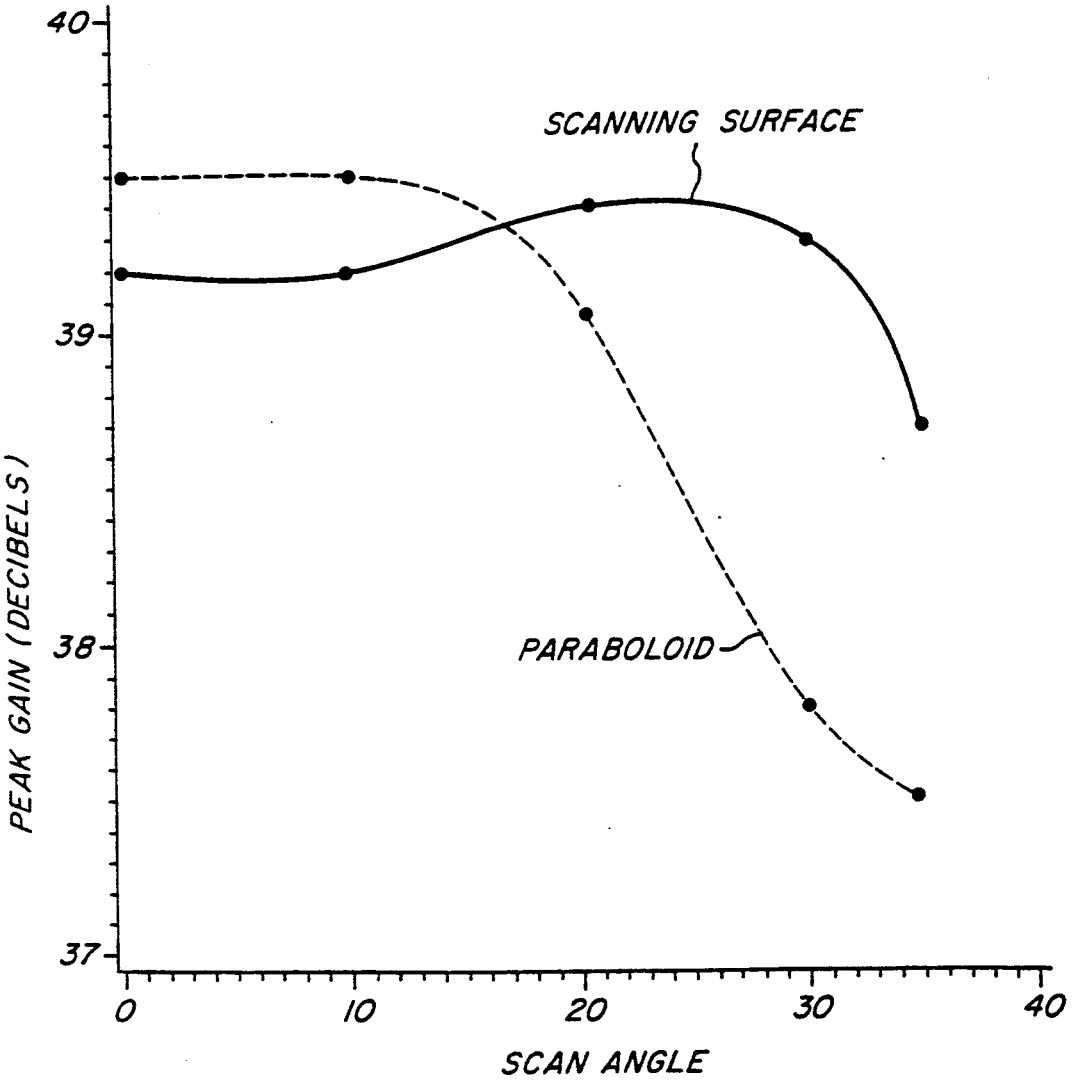
FIG. 12 is a plot of peak gain as a function of scan angle that compares the invention to a similar parabola.
Figure 13:
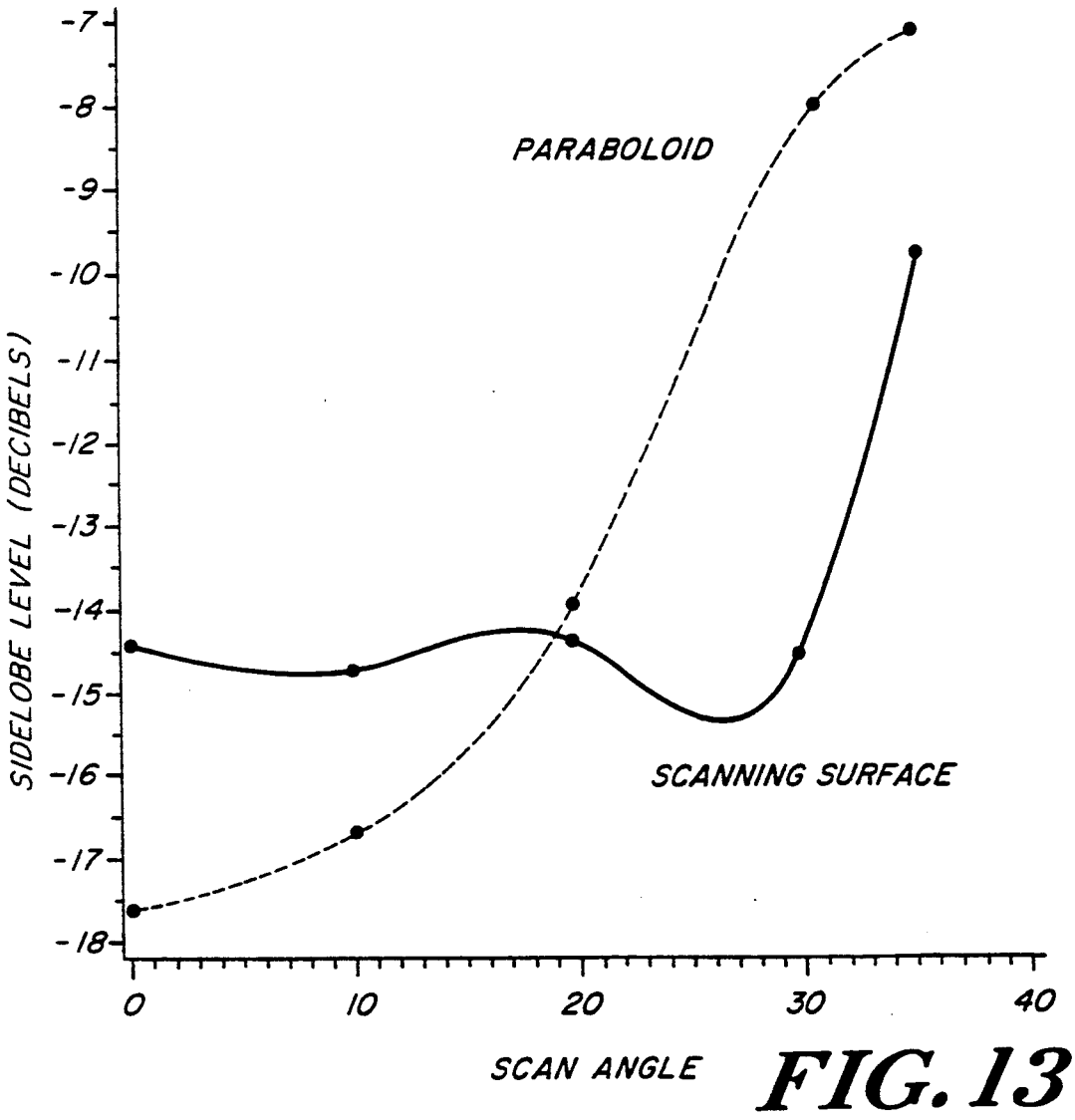
FIG. 13 is a plot of the first sidelobe levels as a function of scan angle that compares the invention to a similar parabola.

A summary of the comparisons are shown in FIGS. 12 and 13, which show the peak gain and highest sidelobe level, respectively, as a function of scan angle. These figures illustrate the superior performance of the reflector design of the invention.

To prevent aperture blockage by the feed array, offset sections of reflector surfaces are often used. It would be possible to illuminate just the upper half ($y>0$) of the previously derived symmetric reflector surface, but it is better to exploit the extra flexibility afforded by relaxing the y-symmetry form of $z_s(x,y)$. That is, adding odd order terms: $Ny+Tx^2y+Ux^4y+Vy^3+Wx^2y^3$ allows for a better match to the ideal tilted paraboloids.

The synthesis procedure begins by translating the coordinate system to $y'=y-y_0$, where $y=y_0$ is the central plane of the offset reflector, ($Y_0=0.3$). Continuing as before by finding the profile in this central plane by least squares gives $z_0$, $r_1$, and $r_2$:

$$z_{c0}=z_0+r_1x^2+r_2x^4 \qquad \text{(Equation 4)}$$

This offset case differs from the symmetric case in that the surface derivatives with respect to y are no longer zero. Since at $$\text{at } y'=0: \frac{\partial Z_{c0}}{\partial y} = N + Tx^2 + Ux^4$$

The N, T, and U coefficients are found by using least squares on the y-derivative of the tiltd parabola at $y'=0$:

$$\frac{\partial Z_p}{\partial y} = \frac{y_0}{\sqrt{(2tb)^2(1-cx/t)-c^2y_0^2}} \qquad \text{(Equation 5)}$$

The scanned focal point is, as before, $$(x_f, y'_f, z_f)=(ct, -y_0, b(t-1)).$$

For the value of the coefficient N not equal to 0, the focal point for the unscanned beam is no longer on the same plane as the symmetric case focal arc $(x_u, y'_u, z_u)=(0, -(y_0+N/2r_1), z_0+\frac{1}{4}r_1-N^2/4r_1+r_1y_0^2)$.

The optimization now proceeds as before to find Q, R, S, V and W.

Other modifications and implementations will occur to those skilled in the art without departing from the spirit and the scope of the invention as claimed. Accordingly, the above description is not intended to limit the invention except as indicated in the following claims.

What is claimed is:

1. A high aperture-efficient reflector antenna comprising:

a linearly extended concave non-conic section reflecting surface resembling a portion of a cylindrical shell, over its entire length being characterized by a cross-section that is a plane curve z which substantially conforms to a pair of imaginary parabolas, each being of the same shape and size, each being disposed in the same plane, and inclined towards each other such that, at a point of intersection, the slope of each parabola is substantially the same, wherein said plane curve z is defined by a polynomial mathematical expression that includes the following additive terms: $-b+r_1x^2+r_2x^4$, and wherein $-b$, $r_1$, and $r_2$ are constant values, and x and z are algebraic variables that correspond to axes x and z of a two-dimensional coordinate system; and a plurality of mutually parallel line transmitters/receivers extending parallel to said linearly extended concave reflecting surface, and disposed, over the entire length of the concave reflecting surface, upon a focal arc of said reflecting surface, said focal arc being characterized by the same shape and position along the entire length of the reflecting surface.

2. A symmetric unitary reflector antenna characterized by a single boresight axis and a scan plane, said antenna including a reflector surface and a feed arc including a plurality of feeds disposed within a focal region of said reflector surface, the shape of said reflector surface being determined by a method comprising the steps of:

forming a three-dimensional coordinate system of mutually orthogonal X, Y, and Z axes for representing said unitary antenna surface as a function z of x and y in three-dimensional space, where the boresight axis coincides with the Z axis, and the scan plane coincides with a plane formed by the X and Z axes;

forming a pair of superimposed, identical imaginary paraboloids, each with a focal length;

placing the vertex of each imaginary paraboloid at equally and oppositely disposed points about the boresight axis of the unitary antenna surface, without rotating either paraboloid;

rotating each imaginary paraboloid about its vertex, within the scan plane, and to an equal angular extent towards the boresight axis until the respective slopes of said imaginary paraboloids are substantially equal at a point of intersection on the boresight axis, to provide a pair of intersecting imaginary paraboloids; and determining the shape of said reflector surface by forming a surface $z=z_1+z_2$, where $$z_1=-b+r_1x^2+r_2x^4, \text{ and}$$

$$z_2=Py^2+Qx^2y^2+Ry^4+Sx^4y^2,$$

said surface z being characterized by having a concavity in closely-fitting relationship with said pair of intersecting imaginary paraboloids, said concavity being in closest-fitting relationship, over a region of each imaginary paraboloid that at least includes said point of intersection, such that the coefficients b, $r_1$, and $r_2$ are determined, and wherein the shape of said surface z is further determined by adjusting the coefficients P, Q, R, and S using a phase error minimization technique.

3. The symmetric unitary reflector antenna of claim 2 wherein the disposition of said feed arc including said plurality of feeds includes the step of:

determining the location of each of said plurality of feeds with respect to said three-dimensional surface z for each selected scan angle of said antenna using a phase error minimization technique.

4. The symmetric unitary reflector antenna of claim 3, wherein said phase error minimization technique includes the steps of:

forming a phase error surface over the illuminated aperture of said antenna for each proposed feed position;

evaluating said phase error surface for indicia of optical aberrations in a beam resulting from the cooperation of a feed in a proposed feed position and said reflecting surface; and fixing said feed in said proposed position if said indicia of optical aberrations are acceptable.

5. The symmetric unitary reflector antenna of claim 2, wherein said phase error minimization technique includes the steps of:

forming a phase error surface over the illuminated aperture of said antenna for both a beam oriented in the boresight direction of said reflector surface, and a beam oriented at the intended maximum scan angle for said reflector surface;

evaluating each phase error surface for indicia of optical aberration of each beam; and changing the numerical value of a least one of said coefficients until said indicia of optical aberration are acceptable.

6. A symmetric unitary reflector antenna with a wide field of view, characterized by having a single boresight axis, and a scan plane, said antenna including a reflector surface and a feed arc disposed within a focal region of said reflector surface, the shape of said reflector surface being determined by a method comprising the steps of:

forming a three-dimensional coordinate system of mutually orthogonal X, Y, and Z axes for representing said unitary antenna surface as a function z of x and y in three-dimensional space, where the boresight axis coincides with the Z axis, and the scan plane coincides with a plane formed by the X and Z axes;

rotating each of two coincident imaginary paraboloidal surfaces, each having a respective focal point and a respective vertex disposed at a point along the single boresight axis, in the scan plane and about their respective focal points such that their respective vertices move away from one another by an angular displacement equal to one-half of the field of view;

translating each paraboloidal surface in the scan plane without rotation until the paraboloidal surfaces are perpendicular to the boresight axis to provide a pair of intersecting imaginary paraboloids;

determining the shape of said reflector surface by forming a surface $z=z_1+z_2$, where $$z_1=-b+r_1x^2+r_2x^4, \text{ and}$$

$$z_2=Py^2+Qx^2y^2+Ry^4+Sx^4y^2,$$

said surface z being characterized by having a concavity in closely-fitting relationship with said pair of intersecting imaginary paraboloids, said concavity being in closest-fitting relationship, over a region of each imaginary paraboloid that at least includes said point of intersection, such that the coefficients b, $r_1$, and $r_2$ are determined, and wherein the shape of said surface z is further determined by adjusting the coefficients P, Q, R, and S using a phase error minimization technique.

7. The symmetric unitary reflector antenna of claim 6 wherein the disposition of said feed arc including said plurality of feeds includes the step of:

determining the location of each of said plurality of feeds with respect to said three-dimensional surface z for each selected scan angle of said antenna by using a phase error minimization technique.

8. The symmetric unitary reflector antenna of claim 7, wherein said phase error minimization technique includes the steps of:

forming a phase error surface over the illuminated aperture of said antenna for each proposed feed position;

evaluating said phase error surface for indicia of optical aberrations in a beam resulting from the cooperation of a feed in a proposed feed position and said reflecting surface; and fixing said feed in said proposed position if said indicia of optical aberrations are acceptable.

9. The symmetric unitary reflector antenna of claim 6, wherein said phase error minimization technique includes the steps of:

forming a phase error surface over the illuminated aperture of said antenna for both a beam oriented in the boresight direction of said reflector surface, and a beam oriented at the intended maximum scan angle for said reflector surface;

evaluating each phase error surface for indicia of optical aberration of each beam; and changing the numerical value of a least one of said coefficients until said indicia of optical aberration are acceptable.

10. A symmetric unitary reflector antenna with a wide field of view, characterized by having a single boresight axis, and a scan plane, said antenna including a reflector surface and a feed arc disposed within a focal region of said reflector surface, wherein a three-dimensional coordinate system of mutually orthogonal X, Y, and Z axes represents said unitary antenna surface as a function z of x and y in three-dimensional space, where the boresight axis coincides with the z axis, and the scan plane coincides with a plane formed by the X and Z axes, the shape of said reflector surface being determined by an equation of the form: $z=z_1+z_2$ where $z_1=-b+r_1x^2+r_2x^4$, and $z_2=Py^2+Qx^2y^2+Ry^4+Sx^4y^2$, said surface z being characterized by having a region of concavity in closely-fitting relationship with a pair of intersecting imaginary paraboloids, where the respective slopes of said intersecting imaginary paraboloids are substantially equal at a point of intersection, said region of concavity being in closest-fitting relationship over a region of each imaginary paraboloid of said pair that at least includes said point of intersection, such that the coefficients b, $r_1$, and $r_2$ are determined, and wherein the coefficients P, Q, R, and S are chosen to achieve a desired level of optical performance of said reflector surface.

11. The symmetric unitary reflector antenna of claim 10 wherein the shape of said surface z is modified for enhanced optical performance by adjusting the coefficients P, Q, R, and S using a phase error minimization technique.

12. The symmetric unitary reflector antenna of claim 10 wherein said pair of imaginary paraboloids is formable by rotating each of two coincident imaginary paraboloidal surfaces, each having a respective focal point and a respective vertex disposed at a point along the single boresight axis, in the scan plane and about their respective focal points such that their respective vertices move away from one another by an angular displacement equal to one-half of the field of view; and then translating each paraboloidal surface in the scan plane without rotation until a portion of each paraboloidal surface is perpendicular to the boresight axis.

* * * * *